United States Patent [19]

Nagahiro

[11] Patent Number: 4,787,993

[45] Date of Patent: Nov. 29, 1988

[54] LUBRICANT

[75] Inventor: Taizo Nagahiro, Yokohama, Japan

[73] Assignee: Mitsui Toatsu Chemicals, Incorporated, Tokyo, Japan

[21] Appl. No.: 69,217

[22] Filed: Jul. 2, 1987

[30] Foreign Application Priority Data

Jul. 17, 1986 [JP] Japan ..... 61-166576
Nov. 28, 1986 [JP] Japan ..... 61-282052

[51] Int. Cl.[4] ..... C10M 125/22; C10M 125/26

[52] U.S. Cl. ..... 252/18; 252/25; 252/45; 252/48.2; 252/51.5 A; 252/52 R; 252/52 A

[58] Field of Search ..... 252/25, 18

[56] References Cited

U.S. PATENT DOCUMENTS

| | | | |
|---|---|---|---|
| 3,338,822 | 8/1967 | Groszek | 252/25 |
| 3,878,113 | 4/1975 | Campbell et al. | 252/12 |
| 3,994,814 | 11/1976 | Cairns | 252/12.2 |
| 4,075,111 | 2/1978 | Bilow et al. | 252/12 |
| 4,201,809 | 5/1980 | Ogawa et al. | 252/25 |
| 4,202,523 | 5/1980 | Radtke | 252/25 |
| 4,256,591 | 3/1981 | Yamamoto et al. | 252/12 |
| 4,308,063 | 12/1981 | Horiuchi et al. | 252/52 A |
| 4,425,247 | 1/1984 | Bely et al. | 252/12.6 |
| 4,488,977 | 12/1984 | Patrichi | 252/12.6 |
| 4,525,286 | 6/1985 | Reick | 252/25 |
| 4,532,054 | 7/1985 | Johnson | 252/51.5 A |
| 4,592,782 | 6/1986 | Davies | 252/12 |
| 4,707,283 | 11/1987 | Hottori et al. | 252/12 |

*Primary Examiner*—William R. Dixon, Jr.
*Assistant Examiner*—Ellen McAvoy
*Attorney, Agent, or Firm*—Oblon, Fisher, Spivak, McClelland & Maier

[57] ABSTRACT

This invention provides lubricants which perform stable operation even at high temperatures and under heavy loading. The lubricants are prepared by dispersing at least one of finely powdered resin selected from aromatic resin and polyimide resin into the fluid fats and oils. The flowable fats and oils may further contain molybdenum disulfide, organic molybdenum, boron nitride, or PTFE.

4 Claims, 1 Drawing Sheet

LUBRICANT

BACKGROUND OF THE INVENTION

The present invention relates to lubricants which are excellent in the effect on the reduction of friction.

Generally on the sliding surface of machinery, there is usually used fluid fats and oils, for example, oils or waxes. When these fluid fats and oils are used, a good sliding effect is exhibited on the normal operating conditions. On the other hand, at high temperatures or under heavy loading, problems have been occurred which are rupture of oil films on the sliding surface, frequent generation of seizure, or a remarkable drop in the efficiency of an engine.

In order to solve such kind of problems it has been proposed to disperse fine powder into the aforementioned fluid fats and oils.

For example, the lubricants have been developed wherein the resin derived from styrene, olefin or isoprene is mixed as a viscosity index improver in addition to disperse the fine powder of tetrafluoroethylene resin(polytetrafluoroethylene, hereinafter abbreviated as PTFE) which is one of the high-temperature resistant resin.

In this case, however, lubricating properties obtained are unsatisfactory when the heavy load is applied on the sliding surface. At high temperatures, 240° C. and above in particular, fluorine based gas evolves as a result of thermal decomposition of PTFE. The gas causes corrosion of metal parts, ill effects on human bodies and moreover public hazards such as atmospheric pollution when PTFE is used for internal combustion engines.

On the other hand, various examinations have been carried out on the dispersed addition of finely powdered ceramics and yet further improvement in performance is desired in a similar manner as above.

SUMMARY OF THE INVENTION

The present invention has been carried out in order to meet the aforesaid demand.

The object of this invention is to provide the lubricants which perform stable operation even at the high temperatures or under the heavy loading and are also excellent in the effect on the reduction of friction.

The above-mentioned object has been achieved by a lubricant which comprises dispersing at least one of finally powdered resin selected from an aromatic resin and a polyimide resin into a fluid fats and oils. The fluid fats and oils may also contain known molybdenum disulfide, organic molybdenum, PTFE or boron nitride.

DETAILED DESCRIPTION OF THE INVENTION

Suitable aromatic resin and polyimide resin which can be used in the practice of this invention include, for example, polycarbonate; polyarylate; polyaryl sulfones such as polysulfone and polyether sulfone; polyaryl ethers such as polyether ketone, polyetherether ketone and polyetherimide; polyaryl sulfides such as polyphenylene sulfide; and polyimide.

The aromatic resin and polyimide resin which are mentioned above have an average particle size of generally 20 μm and less, and preferably 1 μm or less. When the particle size exceeds 20 μm, the lubricants of this invention cannot be obtained which operate stably at the high temperatures and under the heavy loading. The powdered aromatic resin and/or the powdered polyimide resin are used in an amount of 0.001 to 50% by weight of the fluid fats and oils. The amount above 50% by weight is meaningless because it causes the viscosity of the fluid fats and oils only to rise.

The fluid fats and oils which can be utilized in this invention are any materials actually used as the lubricants. The materials include usually known oils and waxes, and further include those added with known additives such as, for example, boron nitride and molybdenum disulfide.

In order to prepare the lubricants of this invention, the aforementioned powdered resin is uniformly dispersed into the fluid fats and oils with stirring at room temperature or at a temperature up to 200° C. The time required for the stirring is usually from 1 to 60 minutes. The resulting uniform dispersion is stable even after being allowed to stand at room temperature and can be used as the lubricant as it is.

As another method, the dispersion may also be prepared by grinding the above-mentioned resin in the fluid fats and oils. Any usually known grinding machine may be utilized for the pulverization of the resin. The temperature during the pulverization is preferably from the room temperature to 200° C. The time required for the grinding is suitably adjusted depending on the desired particle size.

When the fluid fats and oils contain fine powder or liquid of known additives, for example, aforesaid PTFE, boron nitride, molybdenum disulfide and organic molybdenum, the amount of the aforesaid resin to be added is restricted so that the total quantity of powdery resin and additives is up to 50% by weight of the fluid fats and oils. This is because the increased amount of addition leads to an unfavorable viscosity rise of the resulting lubricant.

When two kinds of the aforesaid resin or one of the aforesaid resin with a known additive, are simultaneously added to fluid fats and oils, the weight ratio of these two ingredients is from 40:1 to 1:40. Outside of this range, the effect approaches to the case of single addition and the effect of combined addition is decreased.

As the method for dispersing the plural fine powder into the fluid fats and oils, they may be simultaneously powdered in the fluid fats and oils, or may be separately ground and then mixed. Optionally further pulverization may be permitted after mixing.

Any usually known grinding machines may be employed for the pulverization of the resin and additives. The pulverization is carried out in the range of room temperature to 200° C. The time required for the grinding may suitably be adjusted depending on the desired particle size.

In the so-called master batch process, a high concentration of the finely powdered resin and additives in the fluid fats and oils is prepared and then diluted to a proper concentration by mixing with the fluid fats and oils when needed. The lubricant having the high concentration of finely ground resin and additives for use in such master-batch process is also included in the scope of this invention. In addition, the lubricant of this invention may also be used as grease by kneading with metal soaps.

BRIEF DESCRIPTION OF THE DRAWING

The lubricant of the present invention is compared in FIG. 1 with the additive-free fluid oil (base oil) and the lubricant added with known finely powdered additives. The performance is illustrated as a graph indicating the relationship between load and friction coefficient.

EXAMPLES

Figure 1:
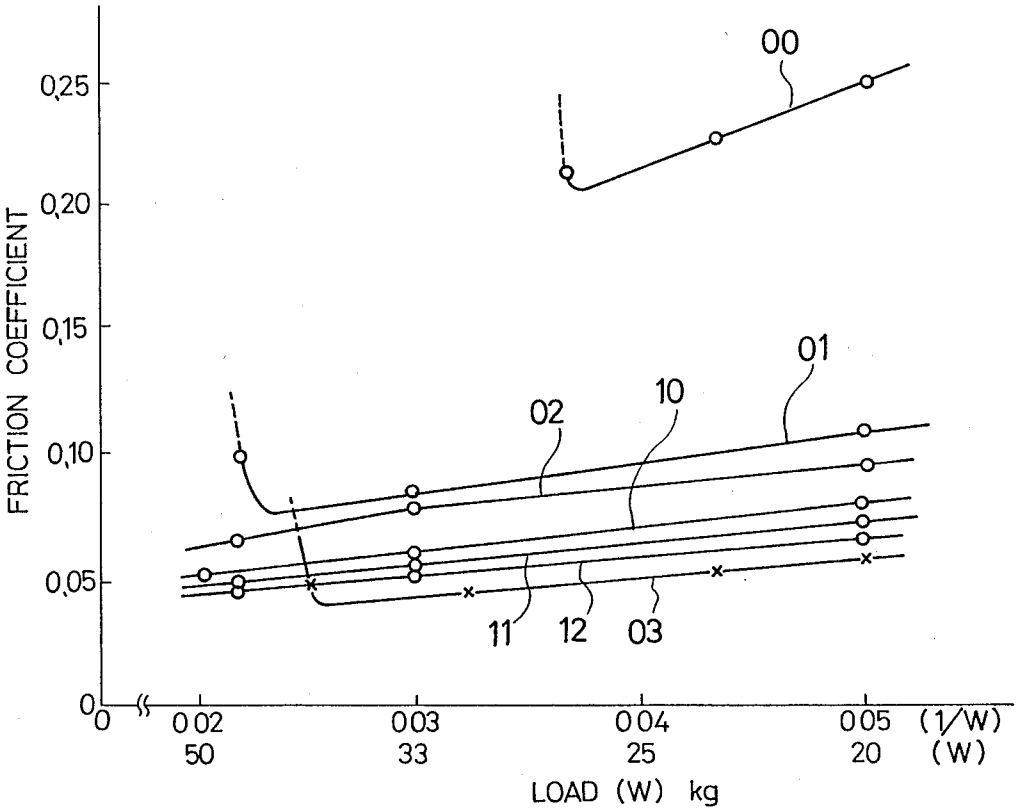

The examples of this invention will be illustrated in comparison with conventional technology.

Machine oil having a viscosity of 100 cst was used as the fluid fats and oils (e.g., base oil).

The base oil was uniformly dispersed with the following resin and additives in the form of fine powder having an average particle size of 1 μm. The friction coefficient was measured at temperature of 40° C. under a load of 20 to 50 kg.

The results are illustrated in FIG. 1 by plotting the load [W] kg and its inverse number ]1/W] as abscissa, and the friction coefficient as ordinate.

| Sample | Additive | Amount* |
|---|---|---|
| 00 | None | — |
| 01 | Molybdenum disulfide | 1.0 |
| 02 | Boron nitride | 1.0 |
| 03 | Tetrafluoroethylene resin | 1.0 |
| 10 | Polyetherether ketone | 1.0 |
| 11 | Molybdenum disulfide | 0.5 |
| | Polyetherether ketone | 0.5 |
| 12 | Boron nitride | 0.5 |
| | Polyetherether ketone | 0.5 |

Note:
*parts by weight per 100 parts by weight of base oil.

As clearly shown in FIG. 1, the lubricants (01 and 03) containing tetrafluoroethylene resin and molybdenum disulfide which are known additives generated seizing under the load exceeding 40 kg and the friction coefficient rose up suddenly.

On the other hand, no seizing phenomenon was found on the lubricant (10) of the present invention wherein polyetherether ketone was used singly. The same effect was also found on the lubricants (11 and 12) of this invention wherein a half quantity of the known additives causing seizure as above was replaced by polyetherether ketone. Moreover any of these lubricants of this invention exhibited superior lubricating properties under each load to the lubricant (02) containing boron nitride which was a known ceramic additive.

The lubricants of this invention are effective for decreasing the friction coefficient on the fluid fats and oils used conventionally. In addition no troubles such as seizing are found on the application at the high temperatures and under the heavy loading.

Therefore the lubricants of this invention are used for members of the internal combustion engines or differential gears which are subjected to the heavy loading or a high speed rotation. Thus the lubricants are very valuable for industrial application.

The lubricants of the present invention may be added with other additives so long as the effect of the lubricants is unharmed in this invention.

What is claimed is:

1. A lubricant which comprises dispersing 0.001–50% by weight of at least one finely powdered resin selected from the group consisting of polyphenylene sulfides, polycarbonates, polysulfones, polyetherimides, polyether ketones, polyetherether ketones, polyether sulfones and polyarylates into fluids fats and oils.

2. The lubricant as claimed in claim 1 wherein said selected resin is polyetherether ketone.

3. The lubricant as claimed in claim 2 wherein the fluid fats and oils further contains molybdenum disulfide.

4. The lubricant as claimed in claim 2 wherein the fluid fats and oils further contains boron nitride.

* * * * *